United States Patent [19]

Ealding

[11] 4,363,872

[45] Dec. 14, 1982

[54] COATED FILM BASES, PHOTOGRAPHIC FILMS DERIVED FROM THE BASES AND PROCESSES FOR THEIR PRODUCTION

[75] Inventor: Cyril J. Ealding, Chester, England

[73] Assignee: Imperial Chemical Industries Limited, London, England

[21] Appl. No.: 243,939

[22] PCT Filed: Mar. 12, 1980

[86] PCT No.: PCT/GB80/00043

§ 371 Date: Feb. 24, 1981

§ 102(e) Date: Feb. 24, 1981

[87] PCT Pub. No.: WO81/02640

PCT Pub. Date: Sep. 17, 1981

[51] Int. Cl.[3] ..... G03C 1/78

[52] U.S. Cl. ..... 430/532; 430/534; 430/535

[58] Field of Search ..... 430/532, 534, 535

[56] References Cited

U.S. PATENT DOCUMENTS

| | | | |
|---|---|---|---|
| 3,090,704 | 5/1963 | Collins et al. . | |
| 3,377,199 | 4/1968 | Altau . | |
| 3,411,911 | 11/1968 | Dykstra | 430/535 |
| 3,536,491 | 10/1970 | Rees et al. . | |
| 3,592,655 | 7/1971 | Dykstra . | |
| 4,135,932 | 1/1979 | Mann | 430/534 |
| 4,225,665 | 9/1980 | Schadt | 430/534 |
| 4,229,523 | 10/1980 | Ohta et al. . | |
| 4,301,240 | 11/1981 | Bruck et al. | 430/534 |

FOREIGN PATENT DOCUMENTS

| | | |
|---|---|---|
| 2416915 | 9/1979 | France . |
| 1106717 | 3/1968 | United Kingdom . |

*Primary Examiner*—J. Travis Brown

*Attorney, Agent, or Firm*—Cushman, Darby & Cushman

[57] ABSTRACT

A coated film base suitable for coating with a light-sensitive photographic emulsion film comprises a self-supporting film of a synthetic linear polyester and a continuous subbing layer applied to at least one surface of said self-supporting film comprising a water-insoluble copolymer of (a) a comonomer selected from acrylic acid, methacrylic acid or a derivative of acrylic acid or methacrylic acid and (b) a copolymerizable sulphonated ethylenically unsaturated comonomer having the general structure:

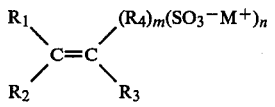

wherein $R_1$, $R_2$ and $R_3$ are the same or different and represent hydrogen, halogen, alkyl, nitrile, amide, amine, ketone, ether or vinyl;

$R_4$ represents phenylene, substituted phenylene, alkylene, carbonyl, ester, substituted ester, naphthylene, substituted naphthylene or vinylene;

M represents hydrogen, ammonium, substituted ammonium or an alkali metal and is preferably lithium, potassium or sodium;

m represents 1 or 0;

n represents an integer 1, 2 or 3 provided that n=1 when m=0, said comonomers (a) and (b) being present in the respective molar percentages in the ranges (a) 26 to 99% and (b) 1 to 50%.

8 Claims, No Drawings

COATED FILM BASES, PHOTOGRAPHIC FILMS DERIVED FROM THE BASES AND PROCESSES FOR THEIR PRODUCTION

The present invention relates to a coated film base suitable for coating with a light-sensitive photographic emulsion, to a light-sensitive photographic film comprising a light-sensitive photographic emulsion applied to the coated film bases and to processes for the production of the film base and the light-sensitive photographic film.

It is known in the photographic art that light-sensitive photographic emulsions, such as conventional light-sensitive gelatinous silver halide emulsions, do not adhere readily to the surfaces of supports derived from thermoplastics films, such as films of synthetic linear polyesters. It has therefore become common practice in the art to improve the adhesion between the film support and the photographic emulsions by pretreating the surface of the film support prior to the application of the photographic emulsion, for example, by coating with one or more polymeric adhesion-promoting layers and optionally with a further adhesion-promoting gelatinous layer. Such layers are often termed subbing layers.

The present invention relates to a subbing copolymer which is effective in promoting the adhesion of a light-sensitive photographic emulsion to a film support of a synthetic linear polyester.

According to the present invention a coated film base suitable for coating with a light-sensitive photographic emulsion layer comprises a self-supporting film of a synthetic linear polyester and a continuous subbing layer applied to at least one surface of said self-supporting film comprising a water-insoluble copolymer of (a) a comonomer selected from acrylic acid, methacrylic acid or a derivative of acrylic acid or methacrylic acid and (b) a copolymerisable sulphonated ethylenically unsaturated comonomer having the general structure:

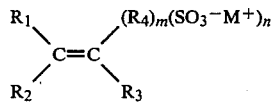

wherein $R_1$, $R_2$ and $R_3$ are the same or different and represent hydrogen, halogen, alkyl, nitrile, amide, amine, ketone, ether or vinyl;

$R_4$ represents phenylene, substituted phenylene, alkylene, carbonyl, ester, substituted ester, naphthylene, substituted naphthylene or vinylene;

M represents hydrogen, ammonium, substituted ammonium or an alkali metal and is preferably lithium, potassium or sodium;

m represents 1 or 0;

n represents an integer 1, 2 or 3 provided that n=1 when m=0, said comonomers (a) and (b) being present in the respective molar percentages in the ranges (a) 26 to 99% and (b) 1 to 50%.

According to another aspect of the invention, a light-sensitive photographic film comprises a light-sensitive photographic emulsion layer applied directly or indirectly to the subbing layer of the coated film base defined in the preceding paragraph.

The invention also relates to a process for the production of a coated film base which comprises applying a continuous subbing layer to at least one surface of a self-supporting film of a synthetic linear polyester wherein the subbing layer is applied from a film-forming composition comprising a water-insoluble copolymer of (a) a comonomer selected from acrylic acid, methacrylic acid or a derivative of acrylic acid or methacrylic acid and (b) a copolymerisable sulphonated ethylenically unsaturated comonomer having the general structure:

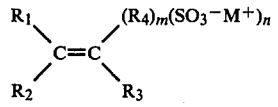

wherein $R_1$, $R_2$ and $R_3$ are the same or different and represent hydrogen, halogen, alkyl, nitrile, amide, amine, ketone, ether or vinyl;

$R_4$ represents phenylene, substituted phenylene, alkylene, carbonyl, ester, substituted ester, naphthylene, substituted naphthylene or vinylene;

M represents hydrogen, ammonium, substituted ammonium or an alkali metal and is preferably lithium, potassium or sodium;

m represents 1 or 0;

n represents an integer 1, 2 or 3 provided that n=1 when m=0, said comonomers (a) and (b) being present in the respective molar percentages in the ranges (a) 26 to 99%, (b) 1 to 50%.

In another aspect of the invention, a process for the production of a light-sensitive photographic film comprises applying a light-sensitive photographic emulsion layer directly or indirectly to the subbing layer applied to the self-supporting film in the process defined in the preceding paragraph.

It has been surprisingly discovered that comonomer (b) is effective in adhering the light-sensitive photographic emulsion to the subbing layer. Comonomer (b) also confers anti-static properties upon the coated film base.

The subbing copolymer may be derived from one or more comonomers falling within the definitions of each of the comonomers (a) and (b).

The self-supporting film may be produced from any suitable synthetic linear polyester which may be obtained by condensing one or more dicarboxylic acids or their lower alkyl diesters, e.g. terephthalic acid, isophthalic, phthalic, 2,5-, 2,6- and 2,7-naphthalene dicarboxylic acid, succinic acid, sebacic acid, adipic acid, azelaic acid, diphenyl dicarboxylic acid, and hexahydroterephthalic acid or bis-p-carboxyl phenoxy ethane, optionally with a monocarboxylic acid, such as pivalic acid, with one or more glycols, e.g. ethylene glycol, 1,3-propanediol, 1,4-butanediol, neopentyl glycol and 1,4-cyclohexanedimethanol. Polyethylene terephthalate films are particularly preferred especially those films which have been biaxially oriented by stretching in sequence in two mutually perpendicular directions typically at temperatures in the range 78° to 125° C. and heat set typically at temperatures in the range 150° to 250° C., e.g. as described in GB patent specification 838 708.

The copolymers of the subbing composition are essentially water-insoluble. It will be appreciated that water-soluble copolymers would be dissolved by the aqueous solutions which are normally used for photographic processing, e.g. for development and fixing, thereby destroying the adhesion of the superimposed light-sensitive photographic emulsion layer to the underlying polyester film. The subbing compositions including the water-insoluble copolymers may nevertheless be applied to the polyester film as aqueous dispersions or alternatively as solutions in organic solvents.

Comonomer (a) for the subbing copolymer is preferably present in an amount 50 to 90 mole % and preferably comprises an ester of acrylic acid or methacrylic acid, especially an alkyl ester wherein the alkyl group contains up to ten carbon atoms such as methyl, ethyl, n-propyl, isopropyl, n-butyl, isobutyl, tertbutyl, hexyl, 2-ethyl, hexyl, heptyl and n-octyl. Copolymers derived from an alkyl acrylate, especially ethyl acrylate, together with an alkyl methacrylate provide particularly effective adhesion between the polyester film and the superimposed light-sensitive photographic emulsion layer. Subbing copolymers comprising an alkyl acrylate, e.g. ethyl acrylate or butyl acrylate, together with an alkyl methacrylate, e.g. methyl methacrylate, desirably in a total molar proportion in the range 55 to 80 mole %, are particularly preferred. The acrylate comonomer of such copolymers is preferably present in a proportion in the range 15 to 45 mole % and the methacrylate comonomer preferably in a proportion exceeding that of the acrylate comonomer generally by an amount in the range 5 to 20 mole %. The methacrylate is preferably present in a proportion in the range 30 to 50 mole %.

Other comonomers falling within the definition of comonomer (a) which are suitable for use in the preparation of the subbing copolymer which may be used instead of but are preferably copolymerised as optional additional comonomers together with acrylic acid or methacrylic acid or esters of the acids include acrylonitrile, methacrylonitrile, halo-substituted acrylonitrile, halo-substituted methacrylonitrile, acrylamide, methacrylamide, N-methylol acrylamide, N-ethanol acrylamide, N-propanol acrylamide, N-methylol methacrylamide, N-ethanol methacrylamide, N-methyl acrylamide N-tertiary butyl acrylamide, hydroxyethyl methacrylate, glycidyl acrylate, glycidyl methacrylate, dimethylamino ethyl methacrylate, itaconic acid, itaconic anhydride and half esters of itaconic acid.

Comonomer (b) which provides anti-static protection for the subbing layer and has also surprisingly been found to be effective in promoting the adhesion of the photographic emulsion layer preferably comprises a salt and most preferably an alkali metal salt, e.g. a sodium salt. Particularly effective salts are the salts of vinyl sulphonic acid, allyl sulphonic acid, methallyl sulphonic acid and para-styrene sulphonic acid, preferably sodium salts thereof. Vinyl sulphonic acid and its salts are especially effective adhesion-promoting comonomers.

Comonomers which function to modify the properties of the subbing layer may optionally be included in the production of the subbing copolymer, such as comonomers which promote the adhesion of the subbing layer in the wet and dry state to the polyester film and/or to superimposed light-sensitive photographic emulsion layers especially those comprising gelatin.

Itaconic acid and itaconic anhydride are particularly effective comonomers in promoting tenacious adhesion to superimposed gelatin-containing layers and are a preferred comonomer according to this invention. Itaconic acid may be copolymerised in an amount comprising up to 20 mole % of the total comonomeric formulation and preferably in the range 2 to 10 mole %.

The adhesion of the subbing layer to the polyester film may be modified by including one or more comonomers having cross-linkable functional groups in the comonomeric recipe for the formation of the subbing copolymer. Epoxy group-containing comonomers, such as glycidyl acrylate and glycidyl methacylate, are particularly effective in providing internal cross-linking within the subbing layer and possibly also cross-linking to the polyester film. A comonomeric amount of 5 to 25 mole %, preferably 15 to 25 mole %, of glycidyl acrylate or glycidyl methacrylate is effective in providing the desired adhesion properties.

Other optional comonomers include vinyl esters such as vinyl acetate, vinyl chloracetate and vinyl benzoate; vinyl pyridine; vinyl chloride; vinylidene chloride; maleic acid; maleic anhydride; butadiene; styrene and derivatives of styrene such as chloro styrene, hydroxy styrene and alkylated styrenes.

When styrene and/or a styrene derivative are employed as a comonomer they must be present only as a minor monomeric constituent, i.e. the molar proportion of the comonomer (a) and (b) defined above must exceed the molar proportion of the styrene and/or styrene derivative. Thus, the molar proportion of styrene and/or the styrene derivative must be less than 33.3 mole %.

Particularly preferred subbing copolymers for use according to the invention include copolymers comprising 15 to 45 mole % of an alkyl acrylate, e.g. ethyl acrylate, 30 to 50 mole % of an alkyl methacrylate, e.g. methyl methacrylate, 10 to 20 mole % of a sulphonated comonomer, e.g. sodium vinyl sulphonate and 7 to 20 mole % of itaconic acid optionally with other comonomers such as glycidyl acrylate or methacrylate in a proportion generally in the range 10 to 20 mole %. Especially effective subbing copolymers are 40/35/10/15 mole % ethyl acrylate/methyl methacrylate/itaconic acid/sodium vinyl sulphonate; 30/45/10/15 mole % butyl acrylate/methyl methacrylate/itaconic acid/sodium vinyl sulphonate; 25/35/10/15/15 mole % ethyl acrylate/methyl methacrylate/itaconic acid/glycidyl methacrylate/sodium vinyl sulphonate; and 20/40/15/10/15 mole % butyl acrylate/methyl methacrylate/glycidyl methacrylate/monomethyl, itaconate/sodium vinyl sulphonate.

Conventional additives may be included in the subbing layer, e.g. adhesion promoters, such as a partially hydrolysed vinyl acetate/vinyl chloride copolymer optionally admixed with a chlorinated phenol, and particulate fillers for providing slip properties.

If desired, the subbing composition may also contain a cross-linking agent which functions to cross-link the subbing copolymer thereby improving adhesion to the polyester film. Additionally, the cross-linking agent should preferably be capable of internal cross-linking in order to provide protection against solvent penetration. Suitable cross-linking agents may comprise epoxy resins, alkyd resins, amine derivatives such as hexamethoxymethyl melamine, and/or condensation products of an amine, e.g. melamine, diazine, urea, cyclic ethylene urea, cyclic propylene urea, thiourea, cyclic ethylene thiourea, alkyl melamines, aryl melamines, benzo guanamines, guanamines, alkyl guanamines and aryl guanamines, with an aldehyde, e.g. formaldehyde. A useful condensation product is that of melamine with formaldehyde. The condensation product may optionally be alkoxylated. The cross-linking agent may be used in amounts of up to 25% by weight based on the weight of the copolymer in the subbing composition. A catalyst is also preferably employed to facilitate cross-linking action of the cross-linking agent. Preferred catalysts for cross-linking melamine, formaldehyde include ammonium chloride, ammonium nitrate, ammonium thiocyanate, ammonium dihydrogen phosphate, ammonium sulphate, diammonium hydrogen phosphate, para toluene sulphonic acid, maleic acid stabilised by reaction with a base, and morpholinium para toluene sulphonate.

The subbing composition may be applied to the polyester film as an aqueous dispersion or a solution in an organic solvent by any suitable conventional coating technique such as dip coating, bead coating, reverse roller coating or slot coating.

The subbing composition may be applied to the polyester film during or after the completion of the process by which the polyester film is produced.

If the subbing composition is applied to the film after the production of the film has been completed, the film may be pretreated or coated in such a way to improve the adhesion of the subbing layer to the film surface. Conventional chemical or physical pretreatments such as coating the film surface with a solution having a swelling, solvent or oxidising action on the film, corona discharge treatment, flame treatment, or ultra-violet light treatment may be used. Alternatively, the plastics film may carry an adhesion-promoting polymeric layer to which the subbing layer according to the invention may be applied.

It has been found however that the subbing compositions bond with acceptable adhesion to the polyester film surface when applied to the film during the process for its manufacture. Satisfactory adhesion is obtainable by direct application of the subbing composition to the polyester film surface without any pretreatment or interposition of an adhesion-promoting layer.

Polyester films are normally manufactured by a process wherein the films are molecularly oriented by stretching in two mutually perpendicular directions. The process is conventionally accomplished by sequentially stretching a flat amorphous polyester film first in one direction and then in another mutually perpendicular direction. Generally, it is preferred to stretch the film firstly in the longitudinal direction, i.e. the direction of passage through the stretching machine, and then in the transverse direction. The stretched films may also be dimensionally stabilised by heat-setting under dimensional restraint. Stretching and heat setting is conventionally carried out by heating the film above ambient temperature. The preferred polyester films for use according to the invention may be made according to such a process. Polyethylene terephthalates are preferably produced by sequential biaxial orientation and heat setting, e.g. as described in GB patent specification 838 708.

Polyester films oriented by sequential stretching may be coated with the subbing composition either before stretching in the first direction of stretching or at a stage intermediate the stretching in the first direction and stretching in the second direction. It is preferred according to this invention that the subbing composition should be applied to the film between the two stretching operations, e.g. by firstly stretching the film in the longitudinal direction over a series of rotating rollers, coating with the subbing composition and then stretching transversely in a stenter oven followed by heat-setting.

Subbing compositions applied to the polyester film surface are preferably applied as aqueous dispersions. The temperatures applied to the coated film during the subsequent stretching and/or heat setting are effective in drying the aqueous medium, or the solvent in the case of solvent-applied compositions, and also in coalescing and forming the coating into a continuous and uniform subbing layer. The cross-linking of cross-linkable subbing compositions is also achieved at such stretching and/or heat-setting temperatures.

The subbing layer is preferably applied to the polyester film at a coat weight within the range 0.1 to 10 $mg/dm^2$, especially 1.0 to 3.0 $mg/dm^2$. For films coated on both surfaces with a subbing layer, each layer preferably has a coat weight within the preferred range.

According to one aspect of this invention, a light-sensitive photographic emulsion layer, e.g. a conventional X-ray or graphic arts gelatinous silver halide emulsion, may be adhered directly or indirectly to the subbing layer. Indirect adhesion may be accomplished by interposing a conventional gelatinous subbing layer between the copolymeric subbing layer and the light-sensitive photographic emulsion layer. However, it has been discovered that adequate wet and dry adhesion can be obtained in the absence of a gelatinous subbing layer and by adhering the light-sensitive photographic emulsion layer directly to the copolymeric subbing layer. Modification of the surface of the copolymeric subbing layer, e.g. by flame treatment, ion bombardment, electron beam treatment, ultra-violet light treatment or preferably by corona discharge, may improve the adhesion of a light-sensitive photographic emulsion layer applied directly to the copolymeric subbing layer but may not be essential to the provision of satisfactory adhesion.

The preferred treatment by corona discharge may be effected in air at atmospheric pressure with conventional equipment using a high frequency, high voltage generator, preferably having a power output of from 1 to 20 kw at a potential of 1 to 100 kv. Discharge is conveniently accomplished by passing the film over a dielectric support roller at the discharge station at a linear speed preferably of 1.0 to 500 m per minute. The discharge electrodes may be positioned 0.1 to 10.0 mm from the moving film surface.

Satisfactory adhesion of light-sensitive gelatinous silver halide emulsions, especially conventional X-ray emulsions, applied directly to the surface of some subbing layer can however be achieved without any prior surface modification, e.g. by corona discharge treatment. Examples of subbing copolymers which provide adequate adhesion without corona discharge treatment are 40/35/10/15 mole % ethyl acrylate/methyl methacrylate/itaconic acid/sodium styrene sulphonate and 41/41.5/8.5/9.0 mole % ethyl acrylate/methyl methacrylate/glycidyl methacrylate/sodium styrene sulphonate.

The light-sensitive photographic emulsion may optionally include any of the conventional additives.

Light-sensitive photographic emulsion layers applied directly or indirectly to the subbing layer of the coated film bases according to this invention adhere with excellent dry and wet adhesions. The coated film bases also have excellent anti-static properties such that they pass effectively and without interruption through coating machines, e.g. for the application of light-sensitive photographic emulsions.

The invention is further illustrated by the following examples, in which dry and wet adhesions have the following meanings and were assessed by the following tests.

*Dry adhesion* refers to the adhesion of a gelatinous silver halide emulsion to the plastics film in the final photographic film, assessed, both before and after processing in standard photographic chemicals, by sticking a self-adhesive tape along the torn edge of the film and rapidly separating the tape from the film.

*Wet adhesion* refers to the adhesion of a gelatinous silver halide emulsion to the plastics film in the final photographic film, assessed, after processing in the standard photographic chemicals and washing in water for 15 minutes by rubbing with a sponge over a series of lines scored in the still wet emulsion.

EXAMPLE 1

An aqueous dispersion of an ethyl acrylate/methyl acrylate/itaconic acid/sodium vinyl sulphonate copolymer of respective proportions 40/35/10/15 mole % was prepared by conventional emulsion polymerisation of the following ingredients:

| | |
|---|---|
| Ethyl acrylate | 286 ml |
| Methyl methacrylate | 319 ml |
| Itaconic acid | 98 g |
| Sodium vinyl sulphonate | 146 g |
| Sodium salt of a sulphated alkyl phenoxy polyethoxy ethanol | 97 ml |
| Ammonium persulphate | 1 g |
| Sodium metabisulphite | 3 g |
| Distilled water | 3000 ml |

A subbing composition was produced from the resulting aqueous dispersion as a mixture of the ingredients:

| | |
|---|---|
| Ethyl acrylate/methyl methacrylate/ itaconic acid/sodium vinyl sulphonate copolymer dispersion | 10 g |
| Hexamethoxy methyl melamine (commercially available as 'Cymel' 300) | 1 g |
| Distilled water | 89 g |

A polyethylene terephthalate film was melt extruded, cast onto a coated rotating drum and stretched in the direction of extrusion to about three times its original dimension in that direction by conventional procedure and was coated on both sides with a uniform layer of the aqueous subbing composition. The coated film was passed into a heated stenter oven where the coatings were dried and the film is stretched about three times its original dimension in the transverse direction in a conventional manner. The film was then heat set under dimensional restraint at a temperature of about 200° C. by conventional procedure. The applied subbing layers were formed into uniform continuous layers each having a dry coat weight of approximately 1.5 mg/dm$^2$ and the film had an overall thickness of about 100 μm.

The subbing layers were then coated with a conventional silver halide X-ray emulsion which was chilled to gel the coating and dried for 20 minutes at 33° C. The dry and wet adhesions of the silver halide emulsion layers to the polyethylene terephthalate film were determined by the tests noted above and were found to be strong and acceptable for photographic use.

The subbed film was found to have excellent antistatic properties when tested at a temperature of 20° C. and a relative humidity of 60% and before the application of the silver halide emulsion layers, i.e. a surface resistivity of $1.6\times10^{10}$ ohms/square.

EXAMPLES 2 TO 4

Example 1 was repeated using similar aqueous dispersions but containing different subbing copolymers as shown in the following Table, with the exception that the hexamethoxy methyl melamine component was omitted from the composition for Example 3.

Prior to the application of the silver halide X-ray emulsions, the subbing layers were subjected to corona discharge treatment by passing the film at 6.1 meters per minute through a commercially available 'Vetaphone' 3 kw treater using a power of 2 kw and electrode to film distance of 1 mm.

In each case the dry and wet adhesions of the silver halide emulsion layers to the polyethylene terepthalate film were assessed by the tests noted above and were found to be strong and acceptable for photographic use.

The subbed films were found to have excellent antistatic properties, represented by the surface resistivities noted in the Table when measured at a temperature of 20° C. and a relative humidity of 60%.

TABLE

| Example | Comonomers for preparation of subbing copolymer | Respective proportions of comonomers in subbing copolymer mole % | Surface resistivity of subbed film measured at 20° C. and 60% relative humidity ohms/square |
|---|---|---|---|
| 1 | EA/MMA/IA/SVS | 40/35/10/15 | $1.6\times10^{10}$ |
| 2 | BA/MMA/IA/SVS | 30/45/10/15 | $2\times10^{10}$ |
| 3 | EA/MMA/IA/GMA/SVS | 25/35/10/15/15 | $1\times10^{11}$ |
| 4 | BA/MMA/GMA/MMI/SVS | 20/40/15/10/15 | $8\times10^{10}$ |

Key:
EA = ethyl acrylate
BA = n-butyl acrylate
MMA = methyl methacrylate
IA = itaconic acid
GMA = glycidyl methacrylate
SVS = sodium vinyl sulphonate
MMI = mono methyl itaconate

EXAMPLE 5

An aqueous subbing latex was prepared by conventional emulsion polymerisation of the following monomeric mixture:

| | |
|---|---|
| Ethyl acrylate | 41.0 mole % |
| Methyl methacrylate | 41.5 mole % |
| Glycidyl methacrylate | 8.5 mole % |

-continued

| | |
|---|---|
| Sodium styrene sulphonate | 9.0 mole % |

The latex was prepared by adding 306 g of the monomeric mixture together with 18.5 ml of an emulsifier comprising nonyl phenol condensed with 12 moles of ethylene oxide, 22.5 g of sodium dodecyl benzene sulphonate and 2 g of potassium persulphate to one liter of water.

A polyethylene terephthalate film was melt extruded and quenched to the amorphous state on a cooled rotating drum. The resulting film was stretched in the direction of extrusion of about 3.5 times its original length. It was then coated on both sides with the aqueous latex prepared above by a roller coating technique and passed into a stenter oven where the coating was dried. The dried coated film was then stretched sideways about 3.5 times its original width and finally heat set at a temperature of about 210° C. The final thickness of the coating on each side of the biaxially drawn film was about 0.2 micron, and the total thickness of the coated film was about 100 microns.

The subbed film had a surface resistivity of about $10^{11}$ ohms/square at 20° C. and a relative humidity of 60%. The copolymeric subbing layers were then coated directly with a conventional gelatinous silver halide photographic emulsion without prior treatment by corona discharge and tested for dry and wet adhesion. The adhesions were strong in each case.

I claim:

1. A coated film base suitable for coating with a light-sensitive photographic emulsion layer which comprises a self-supporting film of a synthetic linear polyester and a continuous subbing layer applied to at least one surface of said self-supporting film wherein the subbing layer consists essentially of:

(1) a water-insoluble copolymer of:

(a) 50 to 90 mole % of comonomer selected from the alkyl esters of acrylic and methacrylic acids wherein the alkyl group contains up to ten carbon atoms;

(b) 9 to 20 mole % of comonomer selected from vinyl sulphonic, allyl sulphonic, methallyl sulphonic and p-styrene sulphonic acids and the salts thereof;

(c) 0 to 20 mole % of comonomer selected from itaconic acid, itaconic anhydride and half esters of itaconic acid;

(d) 0 to 25 mole % of glycidyl acrylate or glycidyl methacrylate; and (2) 0 to 25% by weight, based on the weight of the copolymer, of a cross-linking agent which comprises a condensation product of an amine with formaldehyde.

2. A coated film base according to claim 1, in which comonomer (a) comprises a mixture of an alkyl acrylate and an alkyl methacrylate in a total molar proportion in the range 55 to 80 mole %.

3. A coated film base according to claim 2, in which comonomer (a) comprises a mixture of 15 to 45 mole % of the alkyl acrylate and 30 to 50 mole % of the alkyl methacrylate.

4. A coated film base according to claim 1, in which comonomer (b) comprises vinyl sulphonic acid or a salt thereof.

5. A coated film base according to claim 1, in which the subbing copolymer is derived from one or more additional comonomers selected from itaconic acid, itaconic anhydride, half esters of itaconic acid, glycidyl acrylate and glycidyl methacrylate.

6. A coated film base according to claim 3, in which the subbing copolymer comprises 15 to 45 mole % alkyl acrylate/30 to 50 mole % alkyl methacrylate/10 to 20 mole % sulphonated comonomer/7 to 20 mole % itaconic acid.

7. A light-sensistive photographic film which comprises a light-sensistive photographic emulsion layer applied directly or indirectly over the subbing layer of the coated film base claimed in claim 1.

8. A light-sensitive photographic film according to claim 7, in which the surface of the subbing layer has been subjected to corona discharge treatment prior to the application of the light-sensistive photographic emulsion layer directly thereto.

* * * * *